United States Patent [19]

Ellison et al.

[11] Patent Number: 4,984,742

[45] Date of Patent: Jan. 15, 1991

[54] CONTAINER AND PUMP ASSEMBLY

[75] Inventors: Garry L. Ellison, Grand Rapids; Kim W. Sears, Middleville, both of Mich.

[73] Assignee: Root-Lowell, Ohio

[21] Appl. No.: 392,719

[22] Filed: Aug. 11, 1989

[51] Int. Cl.[5] ..... B05B 9/043

[52] U.S. Cl. ..... 239/373; 222/401; 417/555.1

[58] Field of Search ..... 239/373, 302, 337, 152, 239/153, 154; 222/401, 402; 417/555.1, 555.2; 220/70; 215/1 C

[56] References Cited

U.S. PATENT DOCUMENTS

| | | | |
|---|---|---|---|
| 211,234 | 1/1879 | Giffard | 239/373 |
| 587,532 | 8/1897 | Morgan | 239/373 |
| 2,606,701 | 8/1952 | Huthsing | 239/154 |
| 2,689,533 | 9/1954 | Ericson | 417/555.1 |
| 2,752,200 | 6/1956 | Santarelli | 239/154 |
| 3,709,409 | 1/1973 | Collins | 239/373 |
| 4,537,334 | 8/1985 | Spengler et al. | 222/401 |
| 4,569,275 | 2/1986 | Brunet | 417/555.1 |
| 4,809,944 | 3/1989 | Smith et al. | 417/555.1 |

*Primary Examiner*—Andres Kashnikow
*Assistant Examiner*—Michael J. Forman
*Attorney, Agent, or Firm*—Price, Heneveld, Cooper, DeWitt & Litton

[57] ABSTRACT

A manual pump for pressurizing a closed tank. The pump has a unitary handle, piston rod, valve seat, and split disc air release. An "O" ring is positioned between the valve seat and the split disc air release. A pump cylinder is disposed in the top of the tank and the unitary member is in the cylinder with the handle extending above the top. A piston rod sleeve closes the top of the pump cylinder and provides a stabilizing guide surface for the piston rod as it is moved in and out in the pump cylinder. On the compression stroke of the piston rod, the resilient "O" ring contacts the valve seat sealing the pump cylinder. On the return stroke, the "O" ring contacts the split disc and allows air to enter the pump cylinder through the split disc. An improved garden-type or utility sprayer is also disclosed incorporating the pump into a portable tank adapted to contain a liquid to be dispensed.

18 Claims, 2 Drawing Sheets

CONTAINER AND PUMP ASSEMBLY

BACKGROUND OF THE INVENTION

In a conventional garden or utility sprayer, it is common to have a cylindrical tank in the top of which a hand pump is positioned for compressing air in the tank above the liquid to be dispensed. The conventional hand pump consists of a cylinder having a threaded cap for attachment to a threaded inlet port located on the top of the tank. A handle is disposed outside of the cap, and a connecting rod passes down through the cap to attach to a plunger cup located in the cylinder. The handle and plunger cups are threaded on opposed ends of the piston rod. The bottom of the cylinder is closed off with a spring-actuated valve which allows air to be driven out of the cylinder into the tank while blocking the liquid in the tank from filling the cylinder on the return stroke of the plunger cup. The plunger cup is equipped with a similar valve which allows air to enter the cylinder on the return stroke of the piston rod but which closes the plunger cup on the compression stroke.

It is obvious from the above description that a conventional manual pump for a sprayer incorporates many parts subject to failure or accidental disassembly during use. For example, it is not uncommon for the connecting rod to become disconnected from either the plunger cup or the handle when in use. Also, it is not uncommon for the spring-actuated valve closing the bottom of the cylinder or the valve closing the plunger cup to become worn preventing a full closure thereby disabling the pump. There is nothing more frustrating than carefully mixing a solution of fertilizer solution and loading it into the tank and then installing the pump only to find out that the plunger cup has fallen off the connecting rod because the nut, not visible in the pump cylinder, has fallen off. The pump has to be removed and carefully rinsed before even any attempt can be made to repair the defective pump.

SUMMARY OF THE INVENTION

In accordance with the present invention, an improved manual pump is provided for garden and utility-type sprayers. The pump utilizes a unitary member comprising a handle, a connecting rod, a valve seat, and a split disc air release. A resilient member, such as an "O" ring, is placed on the unitary member between the valve seat and the split disc air release. The unitary member is then inserted into a pump cylinder which is closed at one end by a resilient button valve which normally closes an air outlet from the pump cylinder. The entire pump is made of only five pieces the cylinder, the unitary member, the guide sleeve, the resilient member, and the button valve. The entire pump has only two resilient members that need occasional maintenance. Otherwise, the nuts and threaded shafts and all of the other numerous pieces of a conventional hand pump have been eliminated along with the potential threat of pump failure caused by any one of those parts.

DETAILED DESCRIPTION OF THE PREFERRED EMBODIMENT

Figure 1:
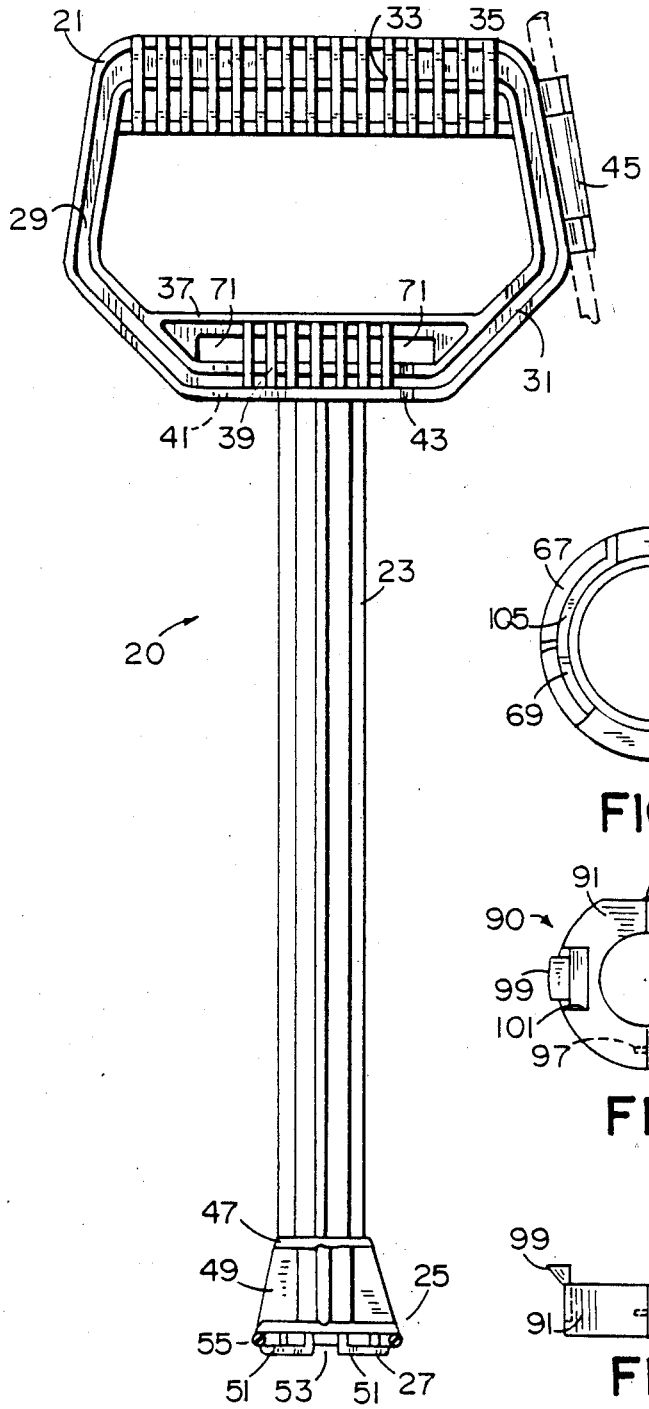
FIG. 1 is an elevational view of the unitary handle, connecting rod, valve seat, and split disc air release.

Referring to FIG. 1, the unitary member is referred to generally by the number 20 and includes a handle portion 21, a connecting rod 23, a valve seat 25, and a split disc air release 27. The assembly 20 is made in one piece by conventional plastic molding techniques and is preferably made of polypropylene with ten per cent (10%) by weight of fiberglass filler. The handle 21 extends from the piston rod 23 in a pair of spaced substantially identical legs 29 and 31 which are joined together by a hand grip 33. For comfort in operating the handle of the pump, the front and back surfaces are made of a plurality of identical spaced sectors 35 which conform comfortably to the fingers when gripping the pump handle. When force is applied by the pump handle to compress air, the legs 29 and 31 are prevented from distorting or spreading by the bridge 37 connecting both legs. The force now applied from the handle 21 is concentrated under the bridge 37 and is directed to the end of the piston rod 23 by a plurality of spaced supporting rods 39 which direct the handle force down immediately above the piston rod 23. In the front and back of the lower portion of the handle 21, are a pair of spaced notches 41 and 43 which assist in locking the handle to the top of the pump cylinder. On the outer surface of the leg 31, a flexible clamp 45 is provided for gripping the wand of the sprayer and holding it in a substantially vertical direction next to the tank which would accompany the pump.

The pump being described is suitable for use with tanks of varying capacity. The size of the tank would require more or less pumping to raise the pressure to the necessary level for adequate spraying. In view of the ready substitutability of the pump, the dimensions given will be suitable for the preparation of a hand pump for use with many different size containers.

The connecting rod 23, extending from the handle 21, is approximately eight and one-half inches in length and three-quarters of an inch in diameter. It is of a substantially "I" configuration having rounded ends on the "I". On opposite sides of the "I" and substantially centrally located therein, is a projection. The "I" configuration and the pair of opposed projections extend from the handle to and through a disc 47 to another disc 25 which forms the valve seat for the pump. The disc 47 is approximately three-quarters of an inch from the disc 25. As can be seen near the bottom of FIG. 1, a plurality of angular braces 49 extend between the disc 47 and the valve seat 25 from both ends of the "I" configuration and from each of the opposed projections out to the edge of the disc 25. These projections substantially reinforce the disc 25 which bears the brunt of the pressure in compressing the air by the hand pump.

Figure 6:
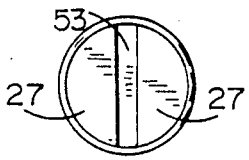
FIG. 6 is a view of the bottom of the unitary member showing the split disc air release.
Figure 7:
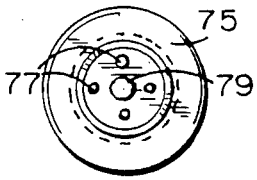
FIG. 7 is an external view of the bottom of the pump cylinder showing the pattern of air flow ports and the aperture for supporting the button valve.

Referring to FIGS. 1 and 6, each half of the split disc 27 is spaced from the valve seat 25 by pairs of identical spacers 51. A split disc 27 is approximately three-sixteenths of an inch away from the valve seat 25 and has a channel 53 approximately three-sixteenths of an inch in width. The valve seat 25 is approximately an inch and a quarter in diameter while the split disc 27 is approximately an inch and three-sixteenths in diameter. Surrounding the area separating the valve seat 25 and the split disc 27 is an "O" ring 55. The "O" ring 55 fits loosely in the space between the valve seat 25 and the air release 27 and moves from one surface to the other as the piston rod moves in the pump cylinder.

Figure 2:
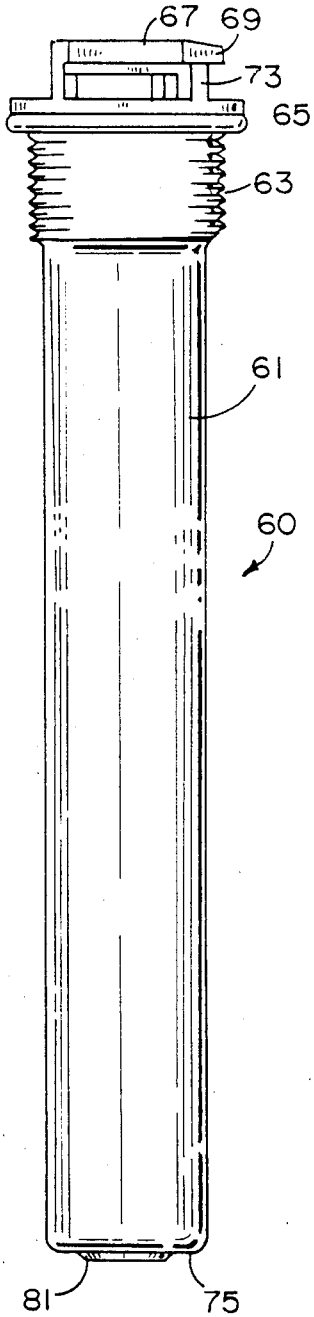
FIG. 2 is an elevational view of the pump cylinder.

As can be seen in FIG. 2, the pump cylinder indicated generally by the number 60 is of a circular configuration and has a long hollow cylinder chamber 61 approximately eight and one-half inches in length and an inch and one-half in diameter. The pump cylinder is preferably made from polypropylene and has a raised externally threaded portion 63 for threading into an internally threaded inlet of the tank to be pressurized. On the top of the threaded portion, the one-piece pump cylinder flairs outwardly at 65 and supports a pair of opposed locking faces 67 which engage with the handle 21 to lock the handle and pump cylinder together to enable a person to lift the tank by means of the handle 21. Each of the locks has a projecting portion 69 which will pass through the apertures 71 in the handle 21 when the handle is twisted. The notches 41 and 43 mate with supporting legs 73 to firmly lock the handle and pump cylinder together.

The bottom portion 75 of the pump cylinder has a plurality of air flow ports 77 spaced about a central aperture 79. The aperture 79 supports a resilient button valve 81, FIGS. 2 and 9, which normally closes the air flow passages 77. The opposite end of the pump cylinder 60 is open for receiving the integral member 20 and the "O" ring 55.

Figure 3:
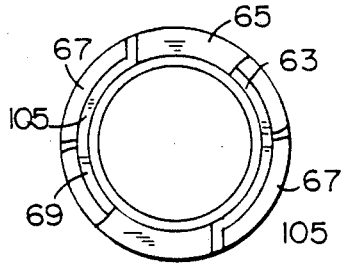
FIG. 3 is a top, plan view of the pump cylinder.
Figure 4:
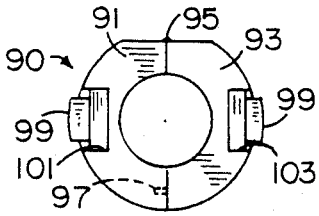
FIG. 4 is a top, plan view of the piston rod guide sleeve.
Figure 5:
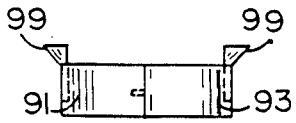
FIG. 5 is a side, elevational view of the piston rod guide sleeve.

Referring to FIGS. 3, 4, and 5, the piston rod guide sleeve, indicated generally by the number 90, is made of two substantially identical sectors 91 and 93 which are hingedly joined together at 95. The preferred hinge is a living hinge made of the same material as the two sectors, preferably high density polyethylene. Opposite the hinge, the two faces of the sectors abut and are joined together by a projection 97 on the face of the sector 93 which enters and is locked in place in an aperture in the opposing face of section 91. A pair of opposed tabs 99 are centrally located in each sector 91 and 93, respectively. In each of the sectors, the top portion is cut away to provide an aperture 101 and 103 so that each of the tabs 99 can be pushed backward toward the center of the piston rod guide sleeve as the guide sleeve enters the top portion 65 of the cylinder pump 60. Each of the lock portions 67 formed on the top of pump cylinder 60 has a camming surface 105 for urging the tabs 99 backward as the piston rod guide sleeve 90 is inserted into the top of the pump cylinder 60.

In assembling the hand pump, the "O" ring 55 is placed about the spacers 51 between the valve seat 25 and the split disc 27. To facilitate movement of the assembly in the pump cylinder 60, it is preferred that the "O" ring be lubricated with petroleum jelly. After the "O" ring is in place, the piston rod guide sleeve 90 should be closed about the piston rod 23. The assembly can then be inserted into the pump cylinder 60 and pushed down to the point where the tabs 99 are in contact with the camming surfaces 105 on twist lock members 67. A further push downwardly against the resistance of the tabs will cause the tabs to pass through the twist lock members and to snap in place seating the piston rod sleeve in the top of pump cylinder 60. The projecting edges of the tabs 99 open out below the lock faces 67 and prevent upward motion of the piston rod from pulling the guide sleeve 90 out of the pump cylinder. The assembled pump can then be placed into a suitable tank, for example, a one gallon or two and one-half gallon conventional spray tank having an internally threaded inlet. The pump can be screwed in place using the handle as a grip to tightly seat the pump in place.

In operation, as the pump is raised, the "O" ring 55 will be pushed downward against the split disc air release allowing air to pass over the top of pump valve seat 25 and around the "O" ring and through the slot into the interior of the pump cylinder 60. The connecting rod 23 can be raised until the disc 47 strikes the bottom of guide sleeve 90. As the handle is then depressed to compress the air, the "O" ring moves upward away from the split disc 27 and positions itself about the edge of valve seat 25 tightly closing off the interior of the pump cylinder 60. The handle can then be depressed forcing the air downward and out through the air flow ports 77 and past the flexible button valve 81 into the tank. After the down stroke is completed, the button valve returns to its normal position closing off the air flow ports 77 and the unitary assembly is ready for another stroke to add more air to the tank.

Figure 8:
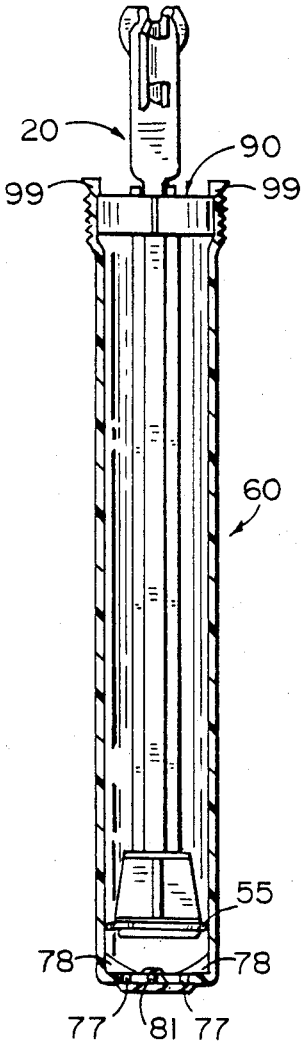
FIG. 8 is a partial, sectional view showing the unitary member supported by the piston rod guide sleeve in the pump cylinder.

In FIG. 8, the unitary assembly 20 can be shown in place in the pump cylinder 60. The "O" ring 55 can be seen contacting the inner wall of the pump cylinder and the button valve 81 can be seen closing the air flow ports 77 in the end of the pump cylinder. The twist locks are not included in this figure so that the tabs 99 can be seen in position holding the piston rod guide sleeve 90 in the end of the pump cylinder 60. On the inside of the end portion 75 of the pump cylinder 60 are positioned a plurality of equally spaced angular reinforcing members 78. The reinforcing members are spread about the air flow ports 77 and protect the bottom 75 of the pump cylinder from blowout.

Figure 9:
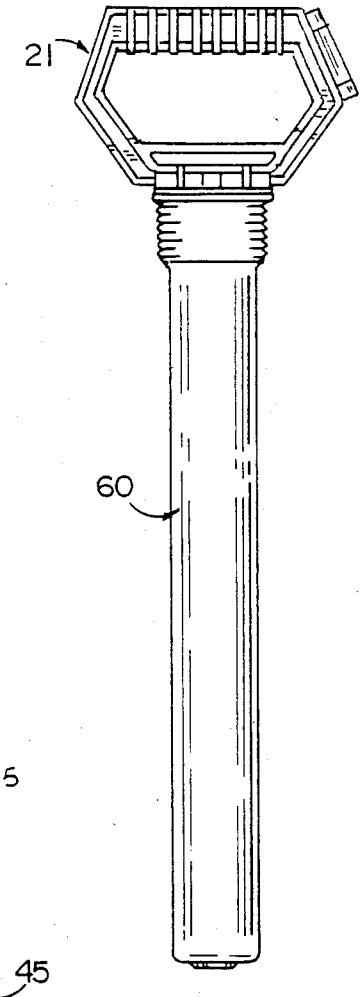
FIG. 9 is an elevational view of the assembled pump showing the pump cylinder and the handle portion of the integral member.
Figure 10:
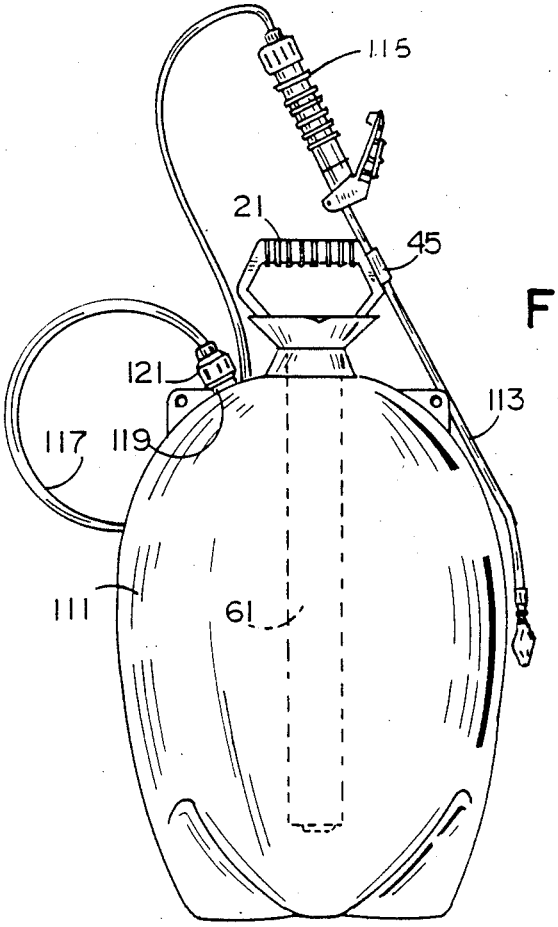
FIG. 10 is an elevational view of an improved utility type sprayer incorporating the pump of the present invention.

The completely assembled pump is shown in FIG. 9 as it is ready for installation in a tank for a portable sprayer. As shown in FIG. 10, the pump cylinder 61 is shown in phantom view within a tank 111 suitable for carrying a liquid material to be dispensed. The handle 21 of the pump projects above the tank, and a dispensing wand 113 is shown being held by clamp 45 on the side of handle 21. The dispensing wand 113 is connected with the tank through a suitable valve and hand grip 115 and a flexible hose 117 which is attached to the outlet port 119 on the shoulder of the tank by a suitable threaded collar 121. This is a typical installation of the hand pump assembly which, as stated before, can be used with many different sizes and shapes of tanks containing materials to be dispensed under pressure. The entire pump consists of only five components which can easily be disassembled for maintenance, lubrication, and routine service.

Though the invention has been described with respect to a specific preferred embodiment thereof, many variations and modifications will become apparent to those skilled in the art. It is therefore the intention that the appended claims will be interpreted as broadly as possible in view of the prior art to include all such variations and modifications.

The embodiments of the invention in which an exclusive property or privilege is claimed are defined as follows:

1. A manual pump for pressurizing a closed container comprising:

a pump cylinder for confining air to be compressed;

a unitary member comprising a handle, a piston rod, a pump valve seat, and a split disc air release for compressing air in said pump cylinder;

a resilient member on said unitary member between said pump valve seat and said split disc air release for forming an airtight seal between said pump valve seat and said pump cylinder on the compression stroke of said unitary member and for opening said airtight seal and admitting air to said pump cylinder through said split disc air release on the return stroke; and a resilient valve on one end of said pump cylinder for releasing pressurized air from said pump cylinder and for blocking the entrance of liquid into said pump cylinder.

2. A manual air pump for pressurizing a closed container comprising:

a handle;

a piston rod joined at one end to said handle and having a remote end;

a pump valve seat joined to said remote end of said piston rod;

an air release joined to and spaced from said pump valve seat, said handle, said piston rod, said pump valve seat and said air release all being a unitary assembly;

a circular resilient member supported between said pump valve seat and said air release;

a pump cylinder having an open end and a closed end with at least one air flow hole therein;

a resilient button valve supported in an aperture in the closed end of said pump cylinder and normally closing said at least one air flow hole; and a piston rod sleeve in the open end of said cylinder for stabilizing the movement of said piston rod in said pump cylinder.

3. A manual air pump for pressurizing a closed container as set forth in claim 2 wherein said handle has a plurality of spaced substantially parallel sectors forming the hand grip.

4. A manual air pump for pressurizing a closed container as set forth in claim 2 wherein a clamp is provided on the side of said handle for gripping and supporting a dispenser wand in a substantially vertical direction.

5. A manual air pump for pressurizing a closed container as set forth in claim 2 wherein said connecting rod has a rounded "I" configuration with an elongated projection extending from each side of the "I" configuration.

6. A manual air pump for pressurizing a closed container as set forth in claim 2 wherein said connecting rod has a plurality of elongated channels for carrying air into said pump cylinder 7. A manual air pump for pressurizing a closed container as set forth in claim 2 wherein a disc surrounds said connecting rod near the valve seat and a plurality of supports extend from said disc to reinforce said valve seat.

8. A manual air pump for pressurizing a closed container as set forth in claim 2 wherein said air release comprises a split circular disc each section of which is separated from said valve seat by at least one spacer.

9. A manual air pump for pressurizing a closed container as set forth in claim 2 wherein said air release comprises a substantially equally divided disc having an air channel separating the two halves.

10. A manual air pump for pressurizing a closed container as set forth in claim 2 wherein the interior surface of the closed end of said pump cylinder has a plurality of reinforcing ribs radiating from a central aperture used to support said button valve and extending to the side wall of said pump cylinder.

11. A manual air pump for pressurizing a closed container as set forth in claim 2 wherein said pump cylinder has a pair cf raised spaced members for mating with recesses in said handle for locking said handle in place to enable the container to be carried by said handle.

12. A manual air pump for pressurizing a closed container as set forth in claim 2 wherein said piston rod sleeve comprises two substantially equal arcuate sectors joined together by a hinge.

13. A manual air pump for pressurizing a closed container as set forth in claim 12 wherein the two arcuate sectors making up the piston rod sleeve are joined along one edge by a living hinge.

14. A manual air pump for pressurizing a closed container as set forth in claim 12 wherein the abutting faces of said hingedly connected arcuate sectors can be joined together by a projection working face on one edge cooperating with a slot in the other.

15. A manual air pump for pressurizing a closed container as set forth in claim 12 wherein said piston rod sleeve comprises an inner piston rod guide surface and an outer pump cylinder contacting surface spaced from each other by a plurality of ribs radiating from the piston rod guide surface and each sector of the sector forming the piston rod sleeve having a solid surface with opposed spaced cutouts for movement of the opposed pump cylinder gripping tabs.

16. A manual air pump for pressurizing a closed container as set forth in claim 12 wherein a pair of opposed flexible members each having a projecting tab extend upwardly along the outer surface of each arcuate sector forming said piston rod sleeve for gripping the edge of the open end of said pump cylinder.

17. A manual air pump for pressurizing a closed container as set forth in claim 16 wherein each of said raised spaced members on said pump cylinder has a camming surface for compressing the opposed pump cylinder gripping tabs when the piston rod sleeve is inserted into the open end of said pump cylinder.

18. A portable sprayer comprising:

a tank for containing a liquid to be dispensed;

an outlet on said tank;

a hose attached to said outlet;

a dispensing valve, wand, and sprayer attached to said hose;

a siphon extending from the input to said hose toward the bottom of said tank;

an inlet centrally disposed on the top of said tank;

a manual air pump for compressing air in said tank comprising:

a pump cylinder for confining air to be compressed mounted in the inlet of said tank;

a unitary member comprising a handle, a piston rod, a pump valve seat, and a split disc air release disposed in operative relation in said pump cylinder;

a resilient member on said unitary member between said pump valve seat and said split disc air release; and a resilient valve on the end of said pump cylinder in said tank for releasing pressurized air from said pump cylinder into said tank and for blocking the entrance of any liquid in said tank into said pump cylinder.

* * * * *